US008062052B2

(12) United States Patent
Wu

(10) Patent No.: US 8,062,052 B2
(45) Date of Patent: Nov. 22, 2011

(54) ELECTRICAL CONNECTOR ASSEMBLY WTH A LATCH MECHANISM

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/081,478

(22) Filed: Apr. 6, 2011

(65) Prior Publication Data

US 2011/0250778 A1 Oct. 13, 2011

(30) Foreign Application Priority Data

Apr. 7, 2010 (CN) ..... 2010 2 0151982

(51) Int. Cl.
*H01R 13/627* (2006.01)

(52) U.S. Cl. ..... 439/352; 439/701

(58) Field of Classification Search ..... 439/352, 439/358, 350, 357, 488, 701
See application file for complete search history.

(56) References Cited

U.S. PATENT DOCUMENTS 5,579,425 A * 11/1996 Lampert et al. ..... 385/59
7,189,098 B1 * 3/2007 Wu ..... 439/352
7,232,329 B1 * 6/2007 Wu ..... 439/358
7,303,438 B2 12/2007 Dawiedczyk et al.
7,510,419 B1 * 3/2009 Sullivan et al. ..... 439/344
7,581,978 B1 9/2009 Briant
2009/0176400 A1 * 7/2009 Davis et al. ..... 439/352
2009/0258526 A1 * 10/2009 Chen et al. ..... 439/352
2009/0275228 A1 * 11/2009 Henry et al. ..... 439/352
2010/0112846 A1 * 5/2010 Kotaka ..... 439/352
2010/0210131 A1 * 8/2010 Reed et al. ..... 439/352
2011/0080008 A1 * 4/2011 Teo et al. ..... 292/197

* cited by examiner

*Primary Examiner* — Neil Abrams
*Assistant Examiner* — Phuong Nguyen
(74) *Attorney, Agent, or Firm* — Wei Te Chung; Andrew C. Cheng; Ming Chieh Chang

(57) ABSTRACT

An electrical connector assembly (100), comprises: an insulative housing (1) having a plurality of receiving spaces (11) formed therein. A plurality of PCB modules (2) are respectively received into the plurality of receiving spaces (15). Two latches (3) are formed on a top surface of the insulative housing, each latch defines a front end (31) connected to a front edge of the top surface of the insulative housing and a rear end (32) cantilevered from the front end of the latch. And an actuator (4) is formed on the top surface of the insulative housing, the actuator defines a rear end (41) connected to a rear edge of the top surface of the insulative housing and a front end (42) cantilevered from the rear end of the actuator, and the front end of the actuator located above the two rear ends of the two latches.

17 Claims, 12 Drawing Sheets

ELECTRICAL CONNECTOR ASSEMBLY WTH A LATCH MECHANISM

FIELD OF THE INVENTION

The present invention generally relates to connectors suitable for transmitting data, more specifically to input/output (I/O) connectors with high-density configuration and high data transmitting rate.

DESCRIPTION OF PRIOR ART

Mini SAS connectors are widely used in the server. And, a physical channel rate of the Mini SAS connector is reach to 3 Gbps. However, the above said data transmitting rate will not meet more and more higher data transmitting rate requirements of the server. And, nowadays, the physical channel rate of the Mini SAS connector is reach to 6 Gbps or more faster.

Additionally, the electrical connector will has a developing trend to form multi-ports on a front end thereof to meet the above said requirements. As a result, a width of the electrical connector becomes larger. Thus, a latch formed on the electrical connector will be difficult to operate to achieve an engagement and disengagement between the electrical connector and the complementary connector.

As discussed above, an improved electrical connector overcoming the shortages of existing technology is needed.

SUMMARY OF THE INVENTION

Accordingly, an object of the present invention is to provide an electrical connector assembly with a latch mechanism easily operated and high data transmitting rate.

In order to achieve the above-mentioned objects, an electrical connector assembly comprises an insulative housing having a plurality of receiving spaces formed therein; a plurality of PCB modules respectively received into the plurality of receiving spaces; two latches formed on a top surface of the insulative housing and spaced apart with each other, each latch defining a front end connected to a front edge of the top surface of the insulative housing and a rear end cantilevered from the front end of the latch; and an actuator formed on the top surface of the insulative housing, the actuator defining a rear end connected to a rear edge of the top surface of the insulative housing and a front end cantilevered from the rear end of the actuator, and the front end of the actuator located above the two rear ends of the two latches.

Other objects, features and advantages of the invention will be apparent from the following detailed description taken in connection with the accompanying drawings.

DETAILED DESCRIPTION OF PREFERRED EMBODIMENTS

Figure 1:
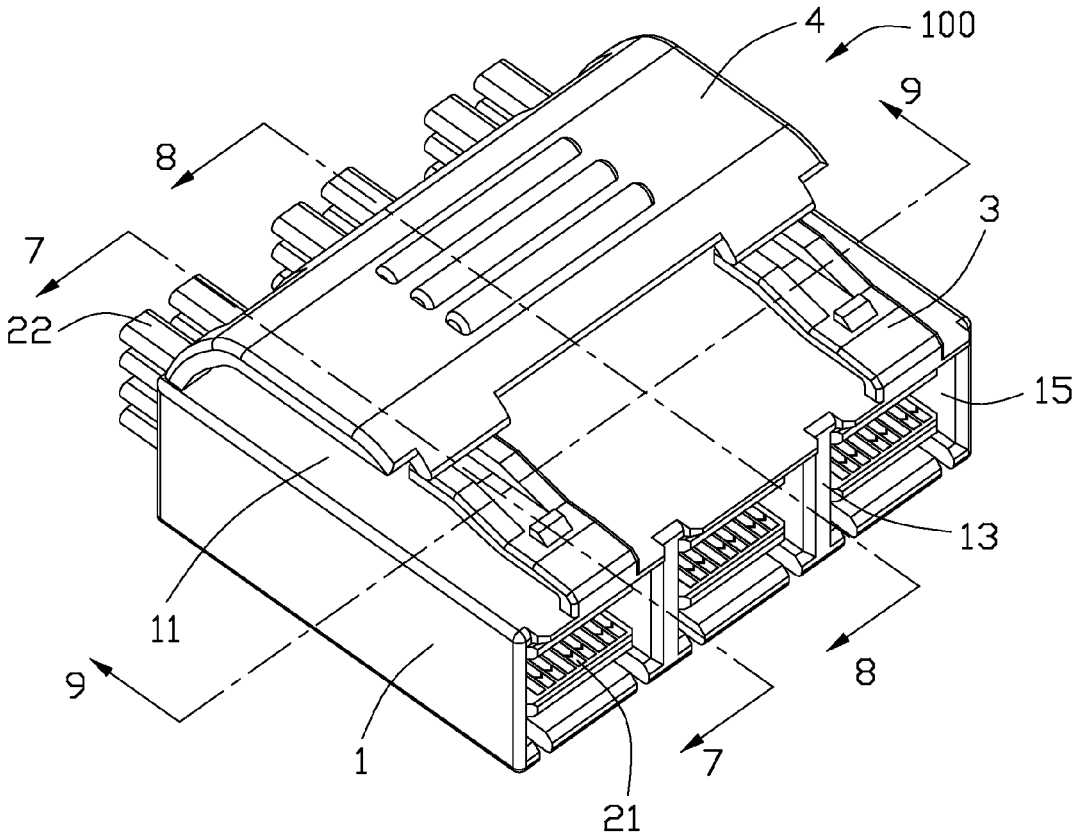
FIG. 1 is a perspective view of an electrical connector assembly in accordance with a first embodiment of the present invention.

Reference will now be made to the drawing figures to describe the present invention in detail.

Figure 2:
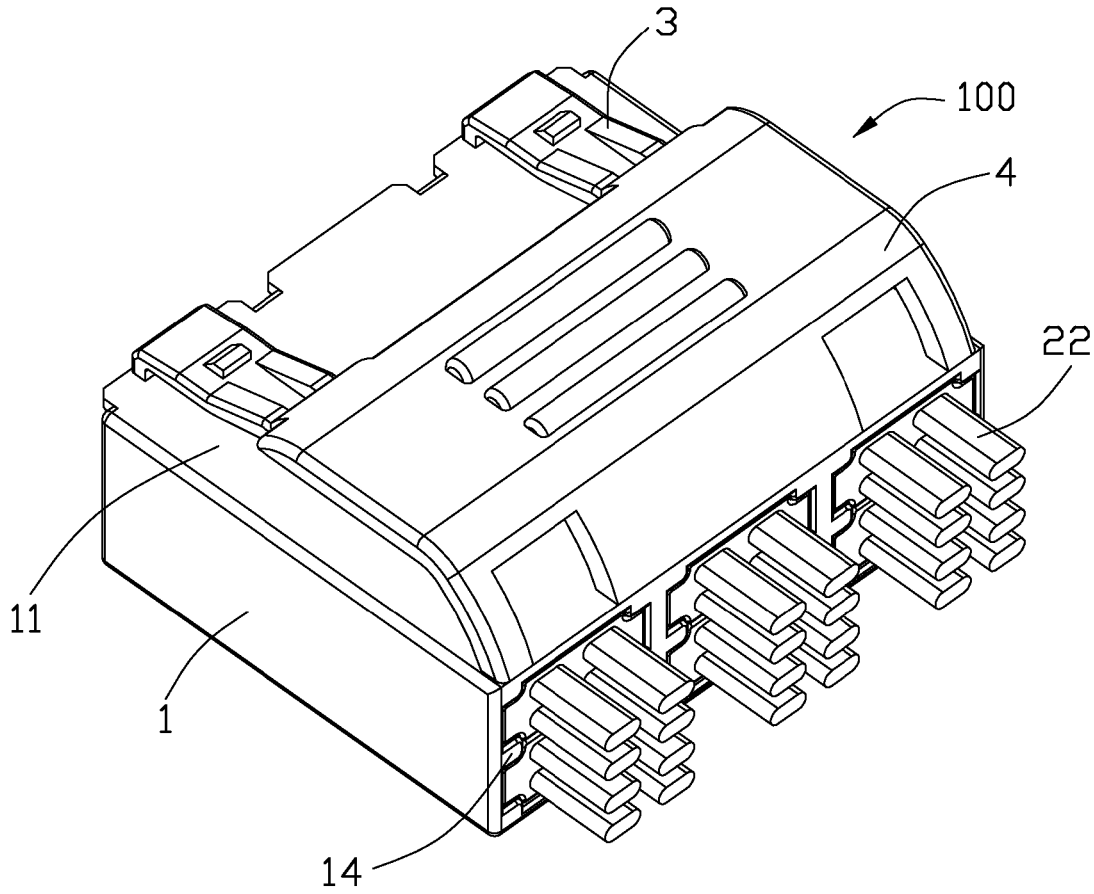
FIG. 2 is similar to FIG. 1, but viewed from another aspect.
Figure 3:
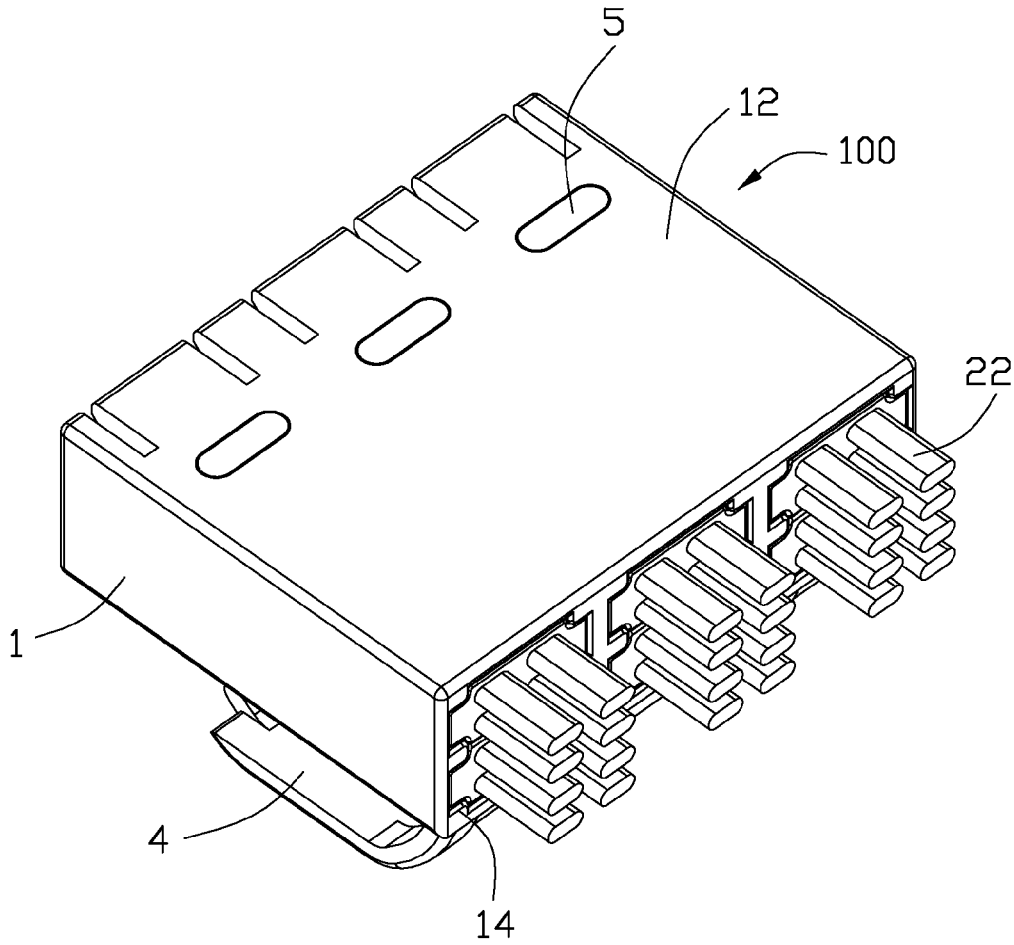
FIG. 3 is similar to FIG. 2, but viewed from another aspect.

FIGS. 1 to 3 illustrate perspective views of an electrical connector assembly 100 made in accordance with a first embodiment of the present invention. Referring to FIGS. 4 to 7, the electrical connector assembly 100 comprises a box-shape insulative housing 1, six PCB modules 2 disposed in the insulative housing 1, two resilient latches 3 formed on a top surface 11 of the insulative housing 1, an actuator 4 also formed on the top surface 11 of the insulative housing 1. The electrical connector assembly 100 further comprises three retainers 4 assembled to the insulative housing 1 and interfered with the six PCB modules 2 to make the insulative housing 1 and the six PCB modules 2 positioned together. The two latches 3 and the actuator 4 are defined as a latch mechanism formed on the electrical connector assembly 100.

Referring to FIGS. 4 to 8, the insulative housing 1 defines a top surface 11 and a bottom surface 12 opposite with each other, a front surface 13 and a rear surface 14 opposite with each other. The insulative housing 1 defines three receiving space 15 arranged along a transversal direction and spaced apart with other. Each receiving space 15 extends from the front surface 13 to the rear surface 14 along a longitudinal direction. The insulative housing 1 defines three partitions 151 respectively formed in the three receiving spaces 15. Thus, each receiving space 15 is divided into a front receiving room 152 and a rear receiving room 153 by the partition 151. And each front receiving room 152 can also be defined as a mating port of the electrical connector assembly 100. A pair of ribs 156 are respectively formed on two inner side surfaces of each rear receiving room 153 to separate two PCB modules 2. Each partition 15 defines two slots 154 throughout the partition 15 along a front to rear direction. Two slots 154 are arranged along a vertical direction and paralleled with each other. The front receiving room 152 communicates with the rear receiving room 153 by two slots 154. In addition, the insulative housing 1 defines three recesses 121 formed on a bottom surface thereof and arranged along a transversal direction. Each recess 121 is in alignment with a partition 151 along a vertical direction. Each partition 15 defines a pair of vertical receiving holes 155 arranged along a transversal direction and extending downwardly and communicated with a corresponding recess 121. Each receiving hole 152 is crossed and communicated with two paralleled slots 154.

Referring to FIGS. 4 to 8, each PCB module 2 comprises a printed circuit board 21, a plurality of cables 22 electrically connected with the printed circuit board 21 and an insulator 23 formed around a front portion of the cables 22 and a rear portion of the printed circuit board 21 for protecting a connection between the first printed circuit board 21 and the cables 22. The printed circuit board 21 defines a mating section 210, a connecting section 211 disposed behind the mating section 210 and a soldering section (not shown) disposed behind the connecting section 211 and electrically connected with the cables 22. The mating section 210 defines a plurality of conductive pads 212 formed on two opposite upper and lower surfaces thereof and arranged along a transversal direction. The soldering section also defines a plurality of conductive pads formed on two opposite upper and lower surfaces thereof and arranged along a transversal direction. The connecting section 211 defines two positioning holes 213 spaced apart with each other and arranged along a transversal direction. When the six PCB modules 2 are all assembled to the insulative housing 1, the mating sections 210 of the printed circuit board 21 of each PCB module 2 is passed through the slot 154 and received into front receiving room 152 of the housing 1. Thus, two mating sections 210 are disposed in each mating port 152 of the electrical connector assembly 100. And, the two insulators 23 are received into a rear receiving room 153 of the receiving space 15 of the insulative housing 1.

Figure 4:
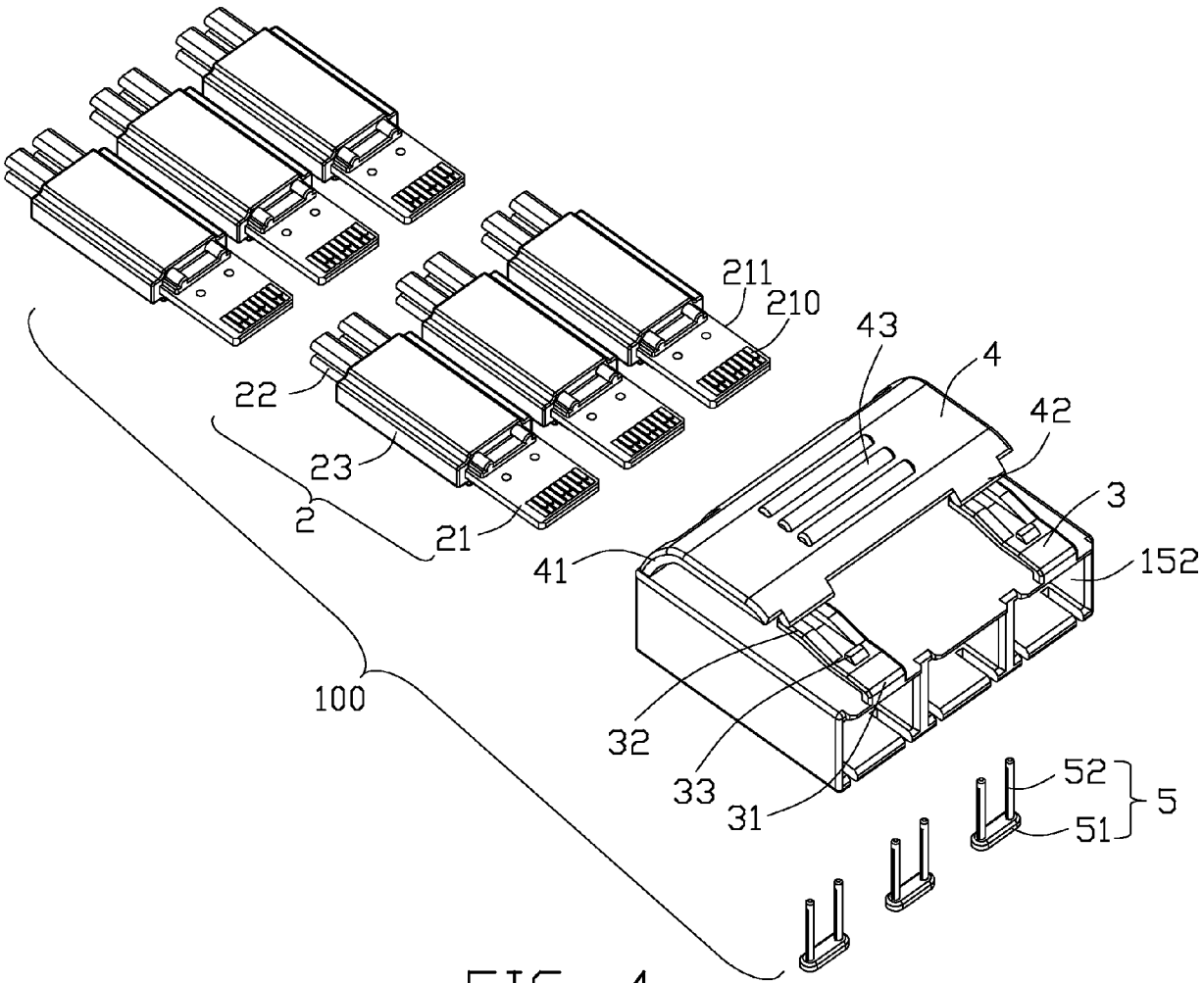
FIG. 4 is an exploded, perspective view of the electrical connector assembly of FIG. 1.
Figure 5:
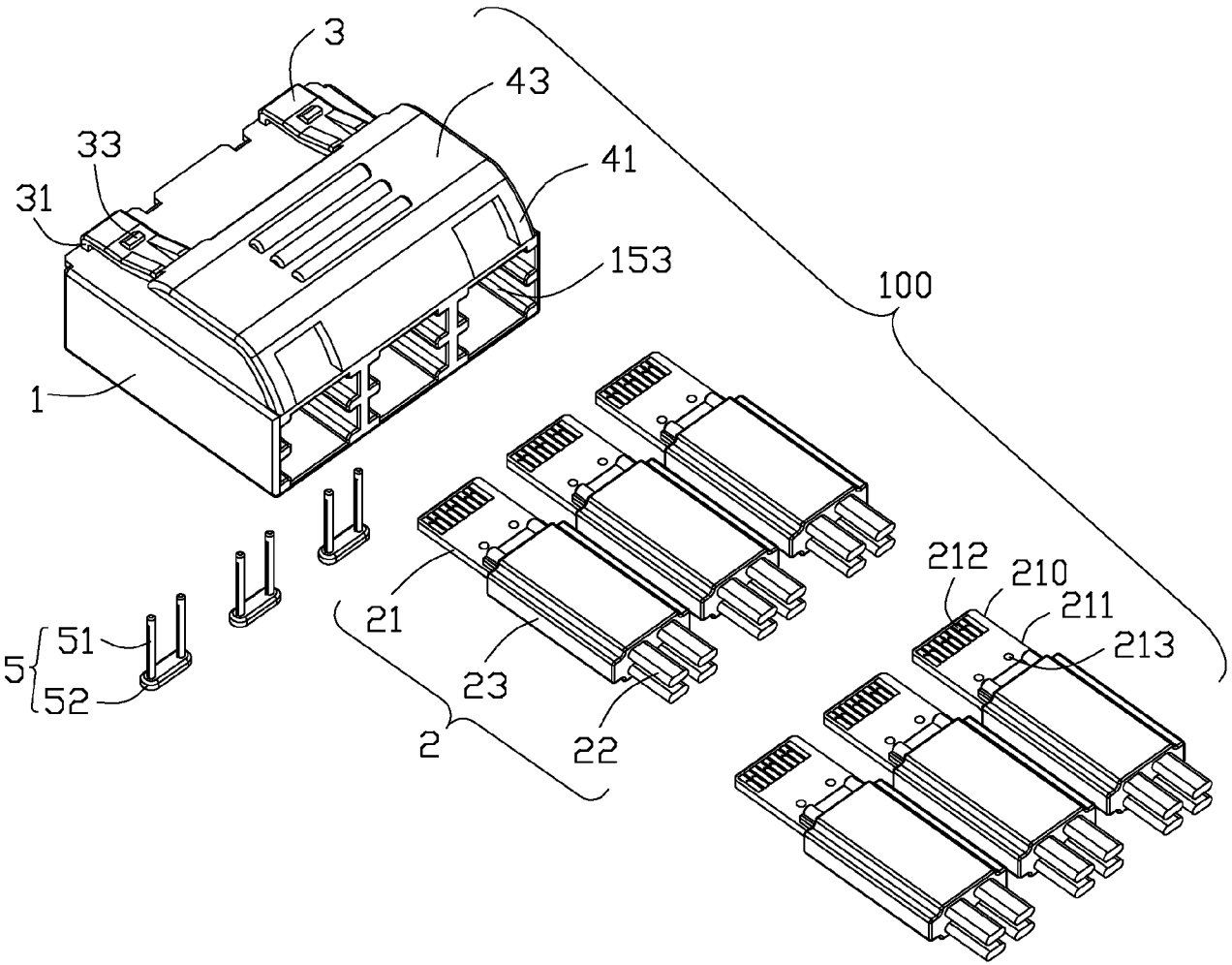
FIG. 5 is an exploded, perspective view of the electrical connector assembly of FIG. 2.
Figure 6:
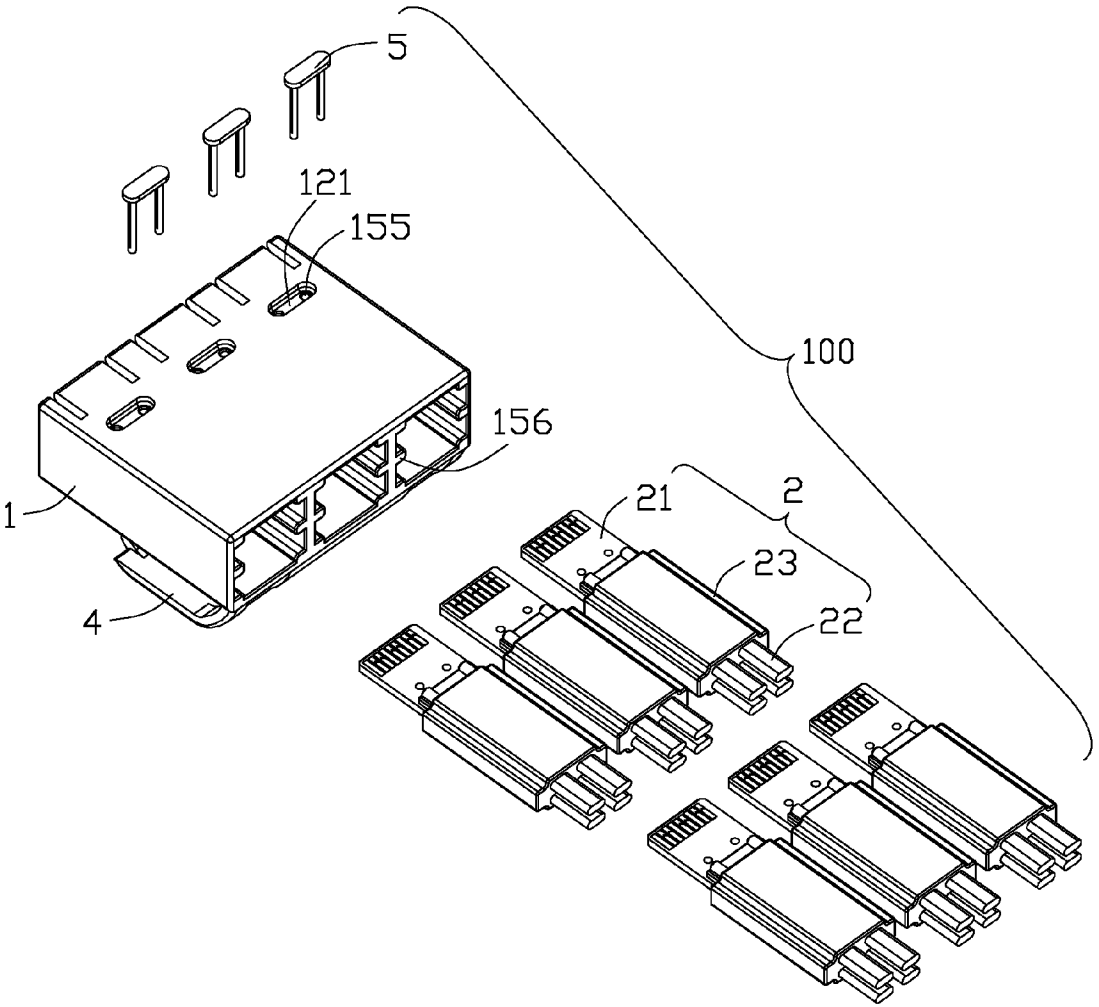
FIG. 6 is an exploded, perspective view of the electrical connector assembly of FIG. 3.
Figure 7:
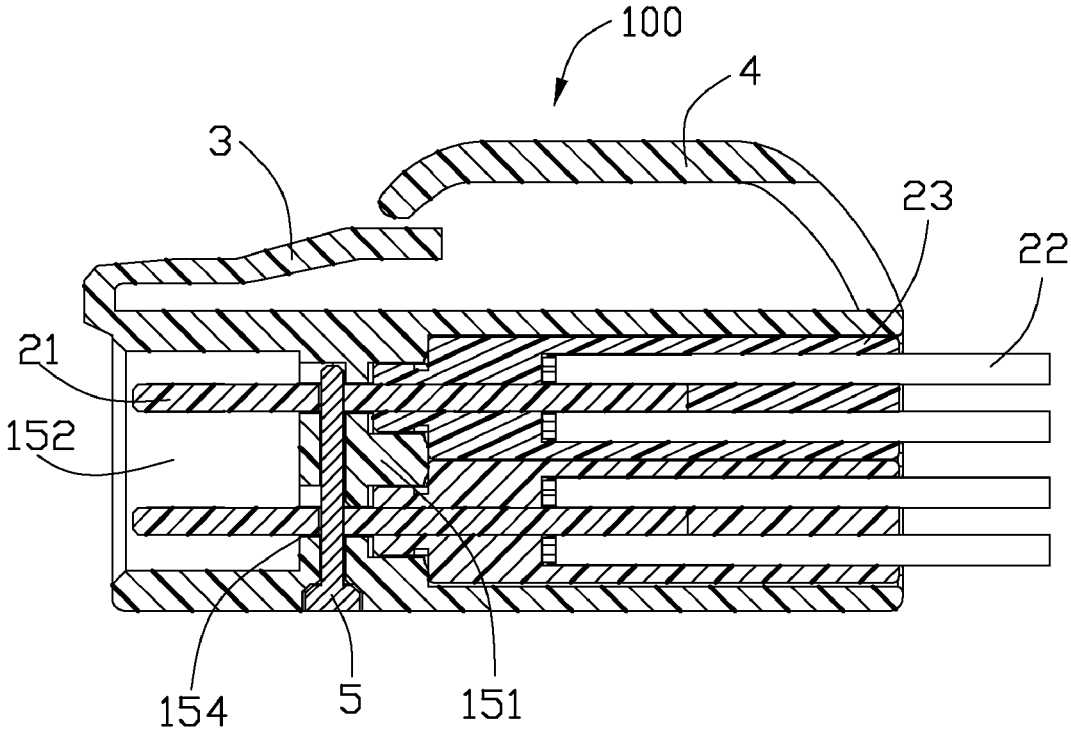
FIG. 7 is a cross section view of the electrical connector assembly of FIG. 1 taken along line 7-7.
Figure 8:
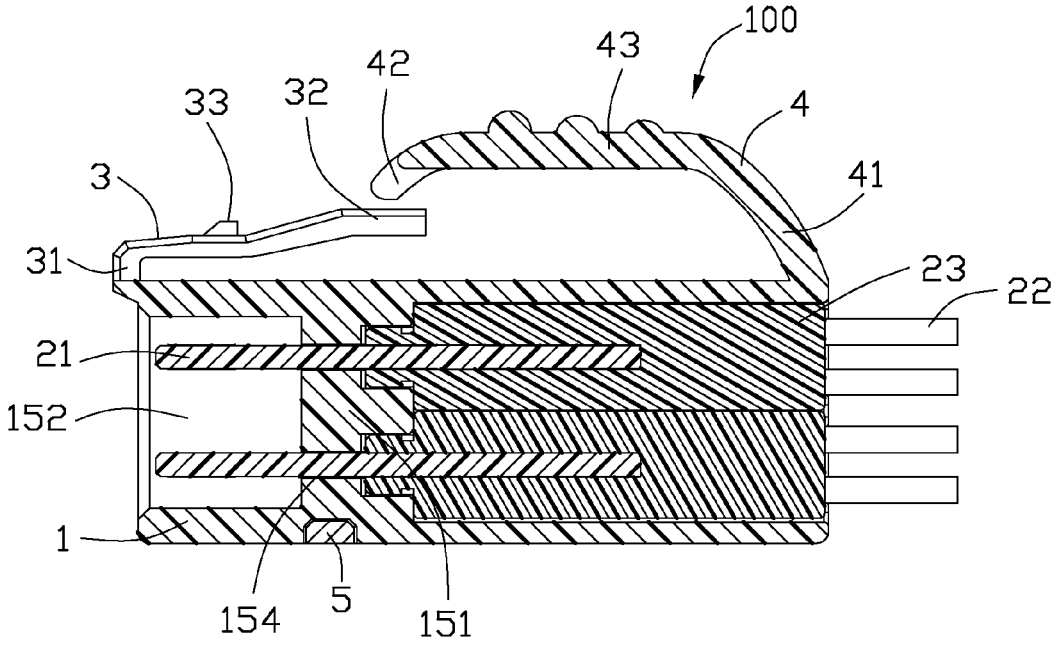
FIG. 8 is a cross section view of the electrical connector assembly of FIG. 1 taken along line 8-8.
Figure 9:
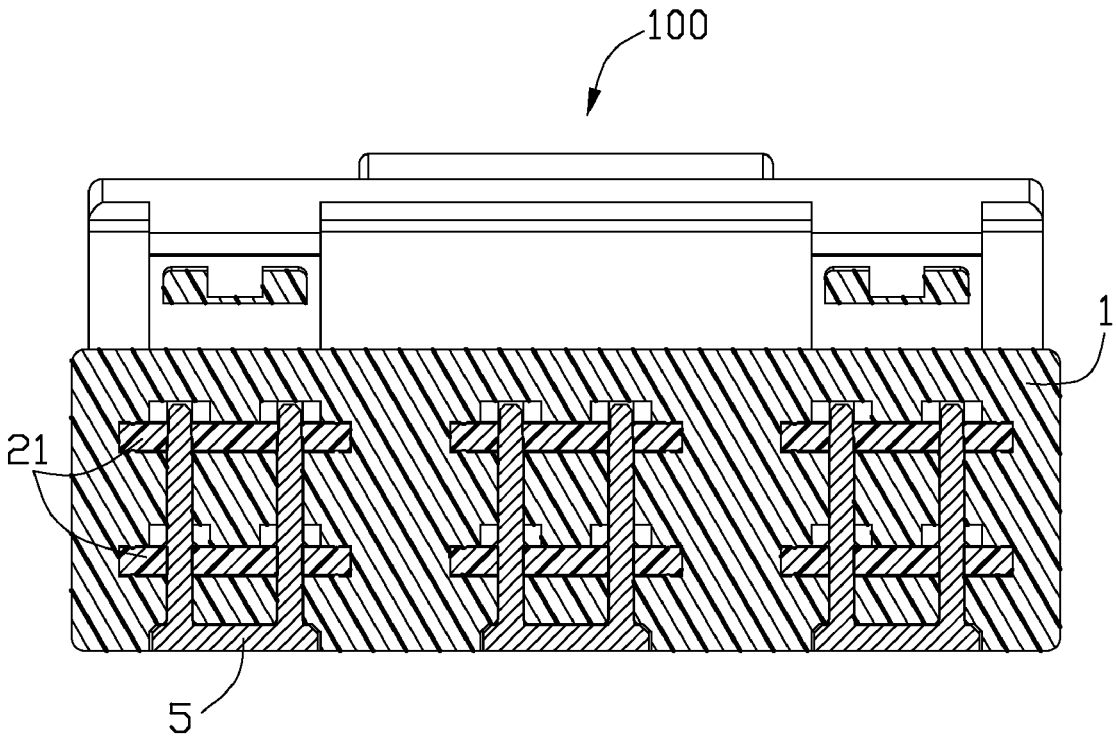
FIG. 9 is a cross section view of the electrical connector assembly of FIG. 1 taken along line 9-9.

Referring to FIGS. 4 to 5 and in conjunction with FIGS. 7 to 8, the two latches 3 are made of insulative material and unitary formed on the top surface 11 of the insulative housing 1. The two latches 3 are located at two lateral sides of the top surface 11 of the insulative housing 1. Each latch 3 has a front end connected to a front edge of the top surface 11 and a rear end cantilevered from the front end located above the top surface 11 of the insulative housing 1. Each latch 3 defines a front connecting section 31 connected to the top surface 11 of the insulative housing 1 and a rear driven section 32 which can be pressed by the actuator 4 along an up-to-down direction. In addition, each latch 3 defines a wedge-shaped projection 33 for latching with a complementary connector (not shown).

Referring to FIGS. 4 to 5 and in conjunction with FIGS. 7 to 8, the actuator 4 is also unitary formed on the top surface 11 of the insulative housing 1. The actuator 4 defines a rear connecting section 41 connected to a rear edge of the top surface 11 of the insulative housing 1 and two front actuating sections 42 respectively located above the two rear driven sections 32 of the two latches 3. The actuator 4 further defines a pressing section 43 connected with the two front actuating sections 42 and the rear connecting section 41. The two front actuating sections 42 are cantilevered from the rear connecting section 41.

Referring to FIGS. 4 to 5 and in conjunction with FIG. 7, each retainer 5 is made of insulative material and has a base portion 51 and a pair of positioning posts 52 extending from a top surface thereof for a distance.

Referring to FIGS. 1 to 9, the assembling process of the electrical connector assembly 100 made in according to a first embodiment of the present invention starts from assembling six PCB modules 2 to the three receiving spaces 11 of the insulative housing 1 along a rear-to-front direction. The mating section 210 of the printed circuit board 21 of each PCB module 2 is received into the front receiving room 152 of the insulative housing 1. The insulator 23 of each PCB module 2 is received into the rear receiving room 153 of the insulative housing 1. Two positioning holes 213 of the printed circuit board 21 of each PCB modules 2 are in alignment with the receiving holes 155 of the insulative housing 1 along an up-to-down direction.

At last, assembling the three retainers 5 to the bottom surface 12 of insulative housing 1. The pair of positioning posts 52 of each retainer 5 are received into the receiving holes 155 of the partition 15 and passed through the two positioning holes 213 of the printed circuit board 21. Thus, each retainer 5 is interfered with two PCB modules 2. The base portion 51 of the retainer 5 is received into the recess 121. Thus, the six PCB modules 2 are firmly positioned to the insulative housing 1 by the three retainers 5.

After the above assembling steps, the entire process of assembling of the electrical connector assembly 100 is finished. When the pressing portion 43 of the actuator 4 is deserved by a downward force, a downward movement of the two actuating section 42 are achieved. Thus, the driven section 32 of each latch 3 will be depressed by the actuating section 42 of the actuator 4 and moved downwardly along an up-to-down direction. As a result, the two projections 33 are moved downwardly along with the driven sections 32 of the two latches 3. At this time, the electrical connector assembly 100 is convenient to mate with a complementary connector (not shown). When the downward force is released from the actuator 4, the two latches 3 will be resumed to an original state. Thus, the electrical connector assembly 100 will latch to the complementary connector (not shown).

Figure 10:
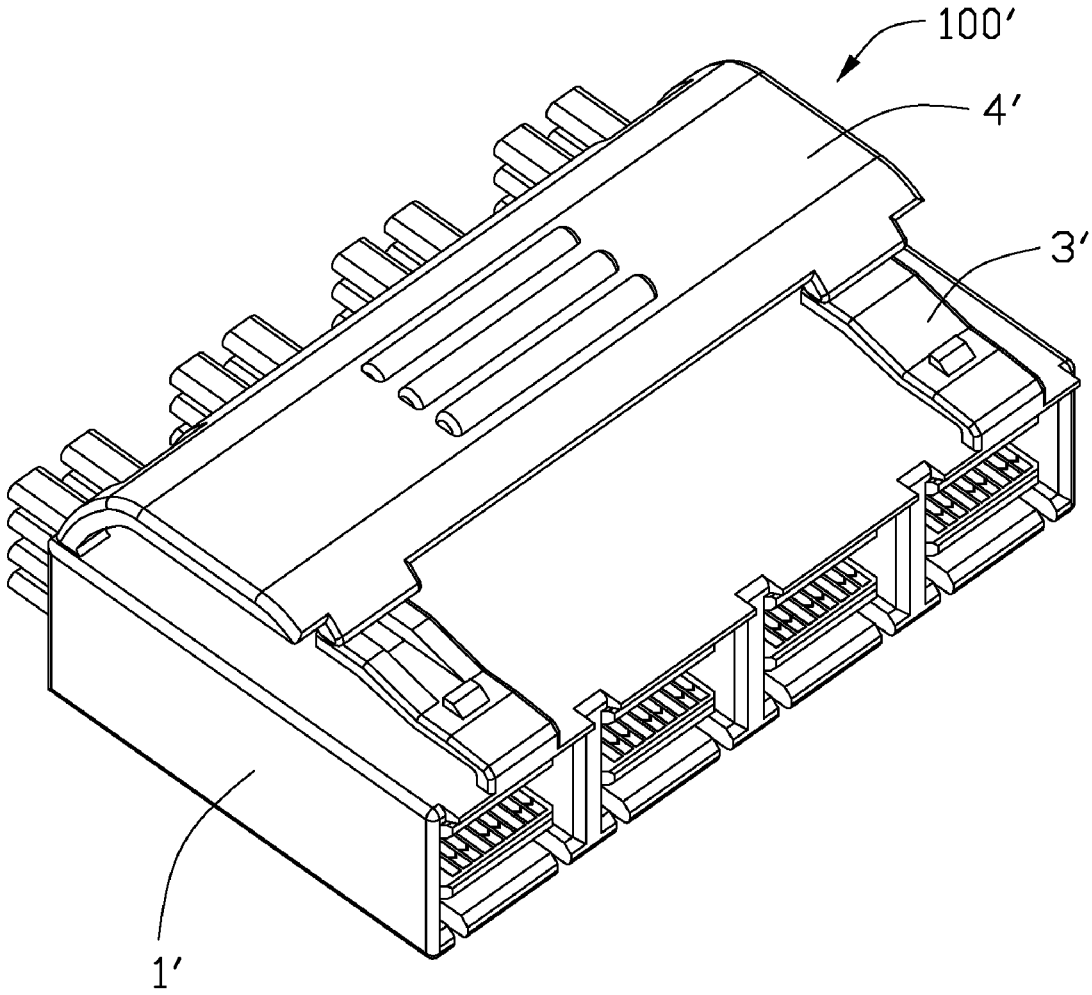
FIG. 10 a perspective view of an electrical connector assembly in accordance with a second embodiment of the present invention.
Figure 11:
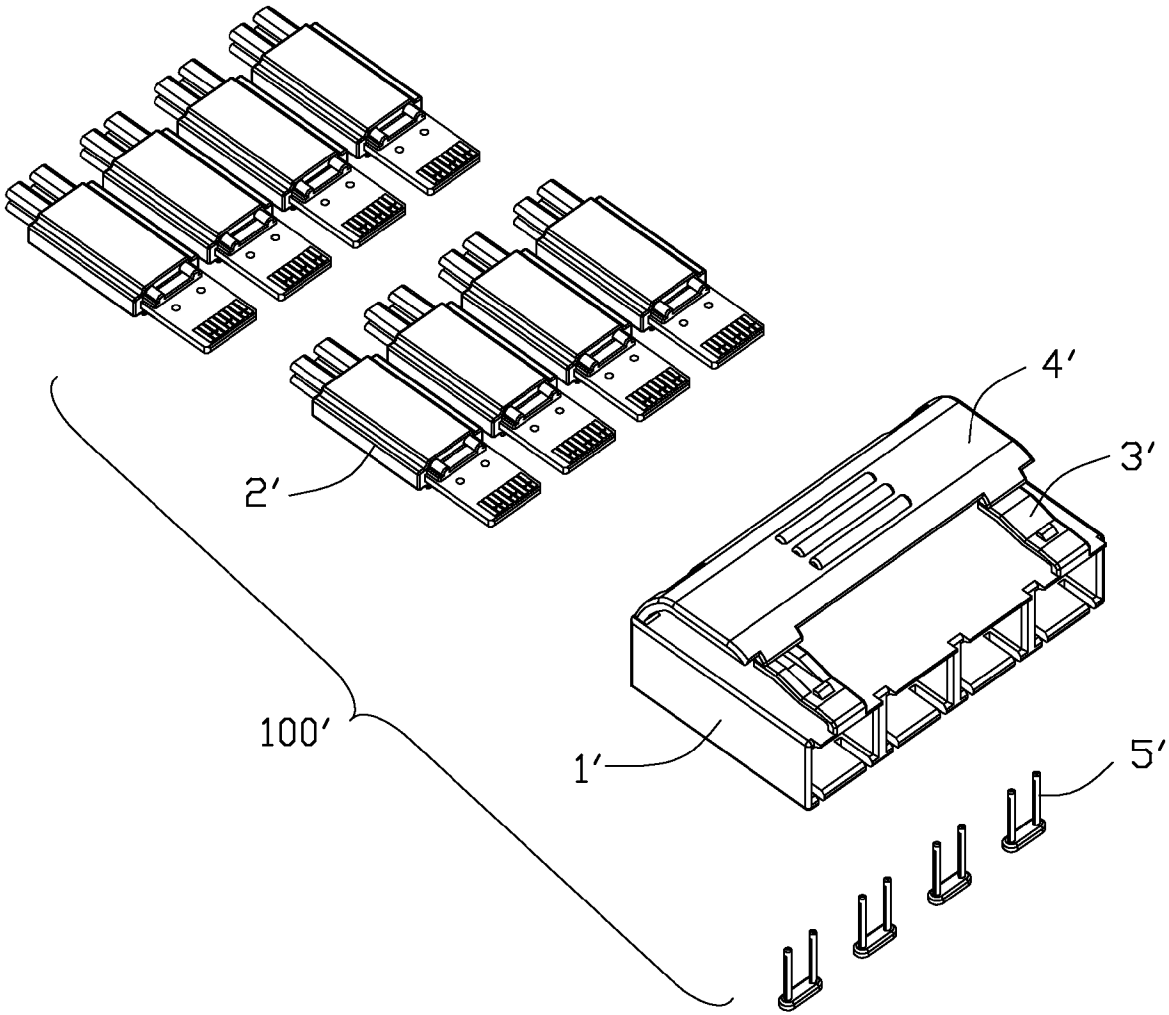
FIG. 11 is an exploded, perspective view of the electrical connector assembly of FIG. 10.
Figure 12:
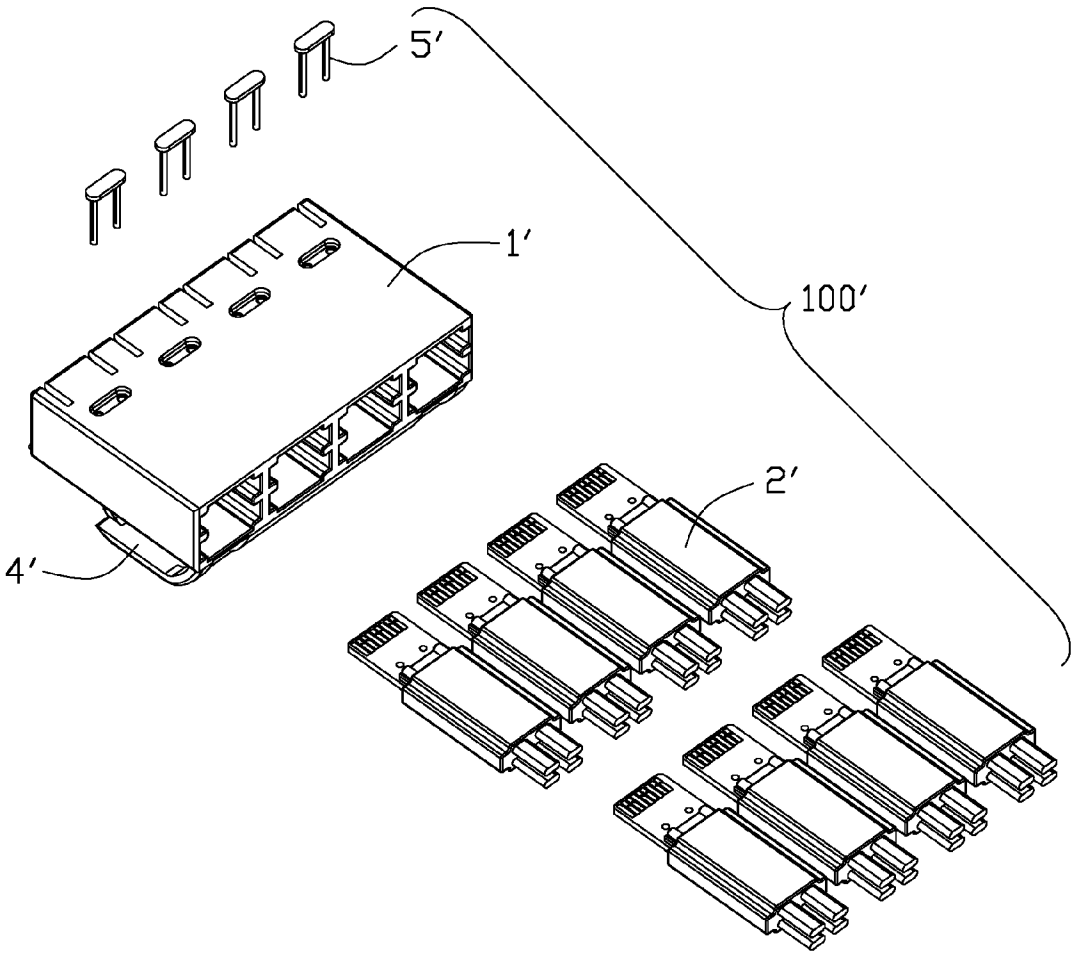
FIG. 12 is similar to FIG. 11, but viewed from another aspect.

Referring to FIGS. 10 to 12, the electrical connector assembly 100' made in accordance with a second embodiment of the present invention comprises an insulative housing 1', eight PCB modules 2' received into the insulative housing 1', two spaced latches 3' unitary formed on a top surface 11' of the insulative housing 1', an actuator 4' also formed on a top surface 11' of the insulative housing 1' and four retainers 5' assembled to the insulative housing 1 and interfered with the eight PCB modules 2' to make the insulative housing 1' and the eight PCB modules 2' positioned together. The two latches 3' and the actuator 4' are defined as a latch mechanism formed on the electrical connector assembly 100'. The assembling process of the electrical connector assembly 100' made in accordance with a second embodiment of the present invention is the same with the assembling process of the electrical connector assembly 100 made in accordance with a first embodiment of the present invention. And the operational principle of the latch mechanism of the electrical connector 100' is the same with the operational principle of the latch mechanism the electrical connector 100.

Referring to FIGS. 10 to 12, there are some different structures between the electrical connector assembly 100' and the electrical connector assembly 100. The insulative housing 1' of the electrical connector assembly 100' defines four spaced receiving spaces 15' and eight PCB modules 2' respectively received into the four corresponding receiving spaces 15'. A width of the insulative housing 1' is larger than a width of the insulative housing 1. A width of the actuator 4' is also larger than that of the insulative housing 1. Each PCB modules 2' has a same structure with each PCB module 2. Each latch 3' has a same structure with each latch 3. And, the electrical connector assembly 100' has four retainers 4' assembled to the insulative housing 1' to achieve a fixation between the housing 1' and the eight PCB modules 2'.

Obviously, the electrical connector assembly 100, 100' respectively has two latches 3, 3' which can be easily actuated by only one actuator 4, 4'. Thus, An engagement and disengagement between the electrical connector assembly 100, 100' and the complementary connector can be easily achieved through two lathes 3, 3' and one actuator 4, 4'.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an insulative housing having a plurality of receiving spaces formed therein;

a plurality of PCB modules respectively received into the plurality of receiving spaces;

two latches formed on a top surface of the insulative housing and spaced apart with each other, each latch defining a front end connected to a front edge of the top surface of the insulative housing and a rear end cantilevered from the front end of the latch; and an actuator formed on the top surface of the insulative housing, the actuator defining a rear end connected to a rear edge of the top surface of the insulative housing and a front end cantilevered from the rear end of the actuator, and the front end of the actuator located above the two rear ends of the two latches;

further including a plurality of retainers each secured to the housing and extending in a corresponding partition and through both said two printed circuit boards;

the actuator defines a cutout structure through which the latch is able to directly communicate with the exterior in the front-to-back direction for consideration of unitary injection-molding of the latch with the housing.

2. The electrical connector assembly as recited in claim 1, wherein each of the receiving space is divided into a front receiving room and a rear receiving room by said partition formed therein.

3. The electrical connector assembly as recited in claim 1, wherein the front end of the actuator comprises two actuating sections respectively located above the two rear ends of the two latches.

4. The electrical connector assembly as recited in claim 3, wherein the actuator further comprises a pressing section connected with the two actuating sections and the rear end.

5. The electrical connector assembly as recited in claim 1, wherein each PCB module comprises a printed circuit board, a plurality of cables electrically connected to a rear end of the printed circuit board and an insulator formed around an connection between the printed circuit board and the plurality of cables.

6. The electrical connector assembly as claimed in claim 5, wherein two PCB modules are received into a receiving space, two insulators of the two PCB modules are filled in a rear section of the receiving space.

7. The electrical connector assembly as recited in claim 1, wherein the two latches are unitary formed on the top surface of the insulative housing, the actuator is unitary formed on the top surface of the insulative housing.

8. The electrical connector assembly as recited in claim 7, wherein each latch defines a projection formed on a top surface thereof for latching with a complementary connector.

9. An electrical connector assembly, comprising:

a housing having a mating port formed on a front surface thereof;

a printed circuit board disposed in the housing and having a front end received into the mating port;

a plurality of cables extending into the housing and electrically connected with a rear end of the printed circuit board;

a pair of latches unitary formed on a top surface of the housing, each latch defining a front end connected to a front edge of the top surface of housing and a rear end cantilevered from the front end thereof; and an actuator unitary form on a top surface of the housing and capable of actuating the pair of latches, the actuator defining a rear end connected to a rear edge of the top surface of the housing and a front end cantilevered from the rear end thereof and located above the two rear ends of the pair of latches;

further including a plurality of retainers each secured to the housing and extending in a corresponding partition and through both said printed circuit board;

wherein the actuator defines a cutout structure through which the latch is able to directly communicate with the exterior in the front-to-back direction for consideration of unitary injection-molding of the latch with the housing.

10. The electrical connector assembly as recited in claim 9, wherein the pair of latches are located on two lateral sides of the top surface of the housing, each latch defines a projection formed on a top surface thereof for latching with a complementary connector.

11. The electrical connector assembly as recited in claim 9, wherein the actuator has a width equal to a width of the insulative housing.

12. The electrical connector assembly as recited in claim 9, wherein the electrical connector assembly comprises an insulator formed on a connection between the printed circuit board and the plurality of cables and disposed in a rear receiving room of the housing.

13. An electrical connector assembly comprising:

an insulative housing defining therein at least one receiving space which an exterior communicates with along a front-to-back direction; at least one module received in the receiving space; at least one deflectable latch unitarily formed on a front region of an exterior face of the housing with an outward projection thereon for locking to a complementary connector; and at least one deflectable actuator unitarily formed on a rear region of the exterior face; wherein a rear edge region of the latch is located under a front edge region of the actuator in an overlapped manner along a vertical direction perpendicular to said front-to-back direction so that pressing the front edge region of the actuator toward the exterior face in the vertical direction to deflect the actuator will further subsequently press the rear edge region of the latch toward the exterior face in the vertical direction to deflect the latch for moving the outward projection toward the exterior face in the vertical direction for releasing the complementary connector;

further including at least one retainer secured to the housing and extending in a corresponding partition and through the module;

wherein the actuator defines a cutout structure through which the latch is able to directly communicate with the exterior in the front-to-back direction for consideration of unitary injection-molding of the latch with the housing.

14. The electrical connector assembly as claimed in claim 13, wherein there are two said latches side by side arranged with and spaced from each other in a transverse direction perpendicular to both said front-to-back direction and said vertical direction while there is only one actuator which has the front edge region with a dimension, in said transverse direction, compliant with said two spaced latches for simultaneously operating said two latches.

15. The electrical connector assembly as claimed in claim 13, wherein the latch defines another cutout in the rear edge region to allow the outward projection directly communicate with the exterior in the front-to-back direction via the cutout of the actuator for consideration of unitary injection-molding of the outward projection with the latch.

16. The electrical connector assembly as claimed in claim 13, wherein a front edge region of the latch unitarily extends from the housing, and the rear edge region of the latch is spaced, in the vertical direction, from the exterior face in a cantilevered manner.

17. The electrical connector assembly as claimed in claim 16, wherein a rear edge region of the actuator unitarily extends from the housing, and the front edge region of the actuator is spaced, in the vertical direction, from the exterior face in the cantilevered manner.

* * * * *